US005985504A

United States Patent [19]

Kawata

[11] Patent Number: 5,985,504

[45] Date of Patent: Nov. 16, 1999

[54] METHOD FOR MANUFACTURING ELECTROPHOTOGRAPHIC PHOTOSENSITIVE BODIES

[75] Inventor: Noriaki Kawata, Saitama, Japan

[73] Assignee: Fuji electric Co., Ltd., Kawasaki, Japan

[21] Appl. No.: 09/094,024

[22] Filed: Jun. 9, 1998

[30] Foreign Application Priority Data

Jun. 10, 1997 [JP] Japan ..... 9-151907

[51] Int. Cl.[6] ..... G03G 5/043

[52] U.S. Cl. ..... 430/127; 430/131; 430/132; 430/133; 430/134; 264/311

[58] Field of Search ..... 430/127, 131, 430/132, 133, 134; 264/104, 255, 311

[56] References Cited

U.S. PATENT DOCUMENTS 4,808,364 2/1989 Blunt et al. ..... 264/311
5,300,391 4/1994 Fabian et al. ..... 430/127
5,840,461 11/1998 Haneda et al. ..... 430/134

FOREIGN PATENT DOCUMENTS 60-170862 9/1985 Japan ..... 430/127
63-246748 10/1988 Japan ..... 430/127
2-146549 6/1990 Japan ..... 430/127

*Primary Examiner*—Roland Martin
*Attorney, Agent, or Firm*—Baker & Botts, L.L.P.

[57] ABSTRACT

The invention is directed to a cost effective method for manufacturing an electrophotographic-photosensitive-body comprising forming a photosensitive layer on the internal surface of a cylindrical mold, polymerizing a resin for a transparent substrate using a centrifugal casting method, and integrating the resin obtained with the photosensitive layer. The electrophotographic-photosensitive-body obtained may be used for an internally illuminating electrophotographic apparatus and that has an excellent printing performance.

6 Claims, 2 Drawing Sheets

METHOD FOR MANUFACTURING ELECTROPHOTOGRAPHIC PHOTOSENSITIVE BODIES

FIELD OF THE INVENTION

The present invention relates to a method for manufacturing an electrophotographic photosensitive body, and in particular, to a method for manufacturing an image recording substrate for an internally illuminating electrophotographic apparatus, such as a copier or a laser printer, i.e., an internally illuminating electrophotographic photosensitive body used as a photosensitive drum.

BACKGROUND OF THE INVENTION

Many conventional recording apparatuses, such as copiers or laser printers, use an aluminum substrate for a photosensitive drum. An exposure process commonly exposes the surface of a photosensitive layer on a substrate in these recording apparatuses. Since conventional methods for obtaining a photosensitive body require devices for charging, exposure, development, transfer, fixing, electrostatic elimination, and cleaning processes to be located around the photosensitive drum, it is difficult to miniaturize the recording apparatus. As a result, a developer may splash from a developing machine, contaminating optics for an exposure apparatus and adversely affecting printing.

To solve this problem, an internally illuminating apparatus of a reduced size has been devised, which prevents the optics from being contaminated by the splashing developer by using a photosensitive drum formed by applying a conductive layer and a photosensitive layer to a transparent substrate; installing a light source for an exposure apparatus inside a photosensitive body; and irradiating the photosensitive body with light from the inside. Existing methods for a photosensitive drum used for such an internally illuminating electrophotographic apparatus form a film of indium tin oxide (hereinafter referred as "ITO") by means of sputtering or vacuum evaporation in order to form a transparent conductive layer on inorganic glass that is a transparent substrate. In addition, Japanese Patent Application Laid Open No. 7-319195 (applicant: FUJITSU Ltd.) describes a photosensitive drum in which doped polyaniline is laminated on a cylindrical glass substrate.

The use of a photosensitive drum for an internally illuminating electrophotographic apparatus has the following problems. The cylindrical inorganic glass substrate is expensive and is susceptible to cracking, and its dimensional accuracy is low; when a transparent conductive layer is formed by means of sputtering or vacuum evaporation, the uniformity of the film thickness and the productivity are low; and the process for forming a doped polyaniline layer is extremely costly.

In view of the prior art manufacturing techniques, there is a need for a supporting substrate for an internally illuminating electrophotographic apparatus in which the material is inexpensive, its dimensional accuracy is excellent, its mechanical strength is sufficient to allow it to be used as a photosensitive drum, it has sufficient chemical stability to maintain its quality as a photosensitive drum even in a general atmosphere that is not particularly controlled, it has sufficient transparency to allow irradiation light to be transmitted therethrough during exposure without being refracted therefrom, it adheres well to a transparent conductive layer laminated thereon, and it has the solvent resistance and heat resistance required during the formation of a photosensitive layer that uses an immersion application process that has a high productivity.

SUMMARY OF THE INVENTION

It is an object of this invention to provide a method for manufacturing a photosensitive drum that is used for an internally illuminating electrophotographic apparatus and has excellent printing performance. In the method of the present invention, the printing performance of a photosensitive drum can be improved, while simultaneously its costs can be significantly reduced, by forming a photosensitive layer on the internal surface of a cylindrical mold and then using a centrifugal casting method to polymerize a resin monomer material for a transparent substrate in order to form a cylindrical substrate.

The method of the present invention is specifically directed to manufacturing an electrophotographic photosensitive body comprising the steps of:

(a) forming a photosensitive layer on the internal surface of a cylindrical mold and (b) centrifugally casting and polymerizing a resin monomer material to form a resin for a transparent substrate on said photosensitive layer such that said resin is integrated with the photosensitive layer.

The photosensitive layer is obtained by forming in order a charge transport layer, a charge generation layer, an underlayer and a conductive layer on the internal surface of the mold. It is preferable that a transparent conductive paint is used as the conductive layer, and the conductive layer has a surface resistivity of about $2\times10^2$ to about $2\times10^6$ ω/□ (ohms/square) in order to obtain a sufficient function for an electrophotographic photosensitive body.

Methylmethacrylate, a monomer of a polymethylmethacrylate resin (PMMA), is preferably used as the resin monomer material to form a resin for a transparent substrate due to its polymerization characteristics. According to this invention, a methylmethacrylate is polymerized to a polymethylmethacrylate resin by means of the centrifugal casting method to obtain a cylindrical substrate. Thus, a photosensitive drum integrated with a photosensitive layer can be obtained by sequentially applying photosensitive layers to the internal surface of a cylindrical mold to form the respective films thereon, forming a conductive layer thereon, and then casting thereon a methymethacrylate that is a substrate material, while simultaneously applying a centrifugal force to the monomer to polymerize to PMMA and harden it. This method enables costs to be significantly reduced. Furthermore, an integral organic photosensitive drum is manufactured that eliminates non-uniform application caused by the variation of drying speed or vibration during conventional drum manufacturing techniques that use an immersion application method. As a result, higher-quality and more economical products are manufactured.

DETAILED DESCRIPTION OF THE INVENTION

Figure 1:
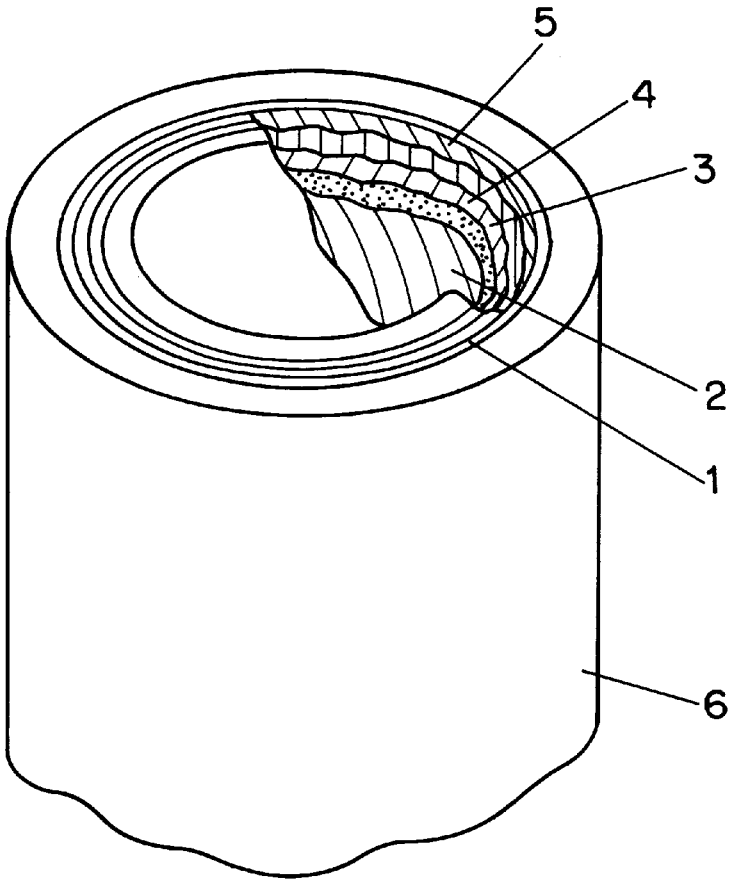
FIG. 1 is a partial cutaway perspective view schematically showing a process for manufacturing a photosensitive drum using a mold.

A preferred embodiment of the method of the present invention is shown in FIG. 1 which is a partial cutaway perspective view schematically showing a process for manufacturing an electrophotographic photosensitive body comprising a photosensitive drum, using a mold. In the Figure, 1 is the transparent drum substrate; 2 is the transparent conductive layer; 3 is the underlayer; 4 is the charge generation layer; 5 is the charge transportation layer and 6 is the casting mold.

The charge transportation layer, 5, the charge generation layer, 4, the underlayer 3, and the conductive layer, 2, are sequentially formed in this order on the internal surface of the cylindrical mold, 6, to obtain a photosensitive layer, followed by the polymerization of a resin monomer material (e.g. methylmethacrylate) to form a resin (e.g. PMMA) for a transparent substrate using a centrifugal casting method. A release agent, e.g., nickel plating containing polytetrafluoroethylene (PTFE), is preferably applied to the internal surface of the mold, 6, in advance. Each layer of the photosensitive layer can be formed by applying a centrifugal force to the mold while rotating it by means of a roller and blowing to the mold, air heated to a predetermined temperature to dry the solvents. To polymerize the resin monomer material for a transparent substrate using the centrifugal casting method, the photosensitive layer is sufficiently hot-air-dried, a specified amount of a mixture of the monomer material and a polymerization catalyst is fed into the mold so that the substrate has a thickness of about 1 to about 5 mm, and the mold is then rotated to apply centrifugal force to the substrate while being heated to about 40° C. to about 80° C.

Figure 2:
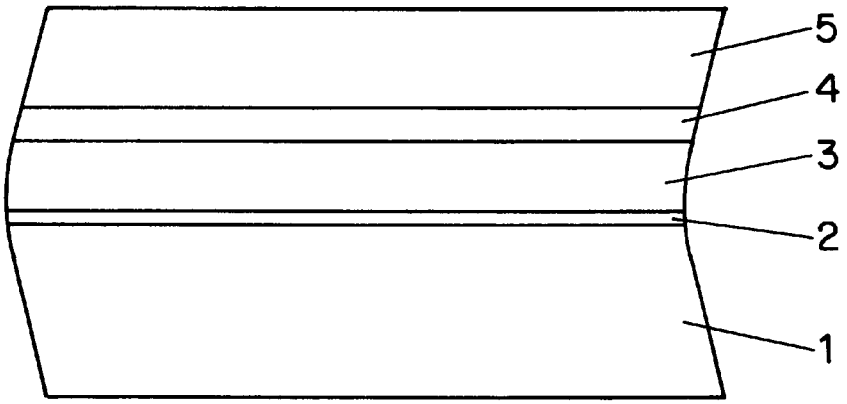
FIG. 2 is a sectional view of a photosensitive drum.

FIG. 2 is a sectional view of a preferred embodiment of a photosensitive drum obtained using the method of the present invention. Specifically, FIG. 2 shows a sectional structure of a transparent conductive layer, 2, formed on the external surface of a photosensitive drum substrate, 1 of a transparent synthetic resin, an underlayer, 3, a charge generation layer, 4, and a charge transportation layer, 5, each laminated on the conductive layer.

According to this invention, the transparent drum substrate, 1, for a photosensitive drum used for an internally illuminating electrophotographic apparatus comprises a transparent synthetic resin suitable for the present manufacturing method, preferably, PMMA.

In addition, an indium tin oxide (ITO) or $SnO_2$ transparent conductive coating material is preferably used to form the transparent conductive layer, 2. The thickness of the conductive layer is generally about 0.5 to about 5 $\mu$m, preferably, about 1 to about 3 $\mu$m. If the thickness of the conductive layer exceeds about 5 $\mu$m, its transparency will be degraded, whereas if the thickness is below about 0.5 $\mu$m, its sheet resistivity will exceed about $2\times10^6$ ω/□.

The underlayer, 3, may comprise alcohol-soluble polyamide, solvent-soluble aromatic polyamide, thermosetting urethane resin, or melamine resin. The alcohol-soluble polyamide is preferably a copolymeric compound such as nylon 6, nylon 8, nylon 12, nylon 66, nylon 610, or nylon 612, or N-alkyl- or N-alcoxyalkyl-modified nylon. Specific compounds include Amilan CM 8000 (manufactured by Toray Industries, Co., Ltd.; 6/66/610/12 copolymeric nylon), Elbamide 9061 (manufactured by Du Pont Japan Inc.; 6/66/612 copolymeric nylon), and Daiamide T-170 (manufactured by Daicel-Huels; copolymeric nylon consisting mainly of nylon 12). Furthermore, inorganic fine powders such as $TiO_2$, alumina, calcium carbide, or silica may be added to the underlayer 3. The thickness of the underlayer may be about 0.05 to about 20 $\mu$m, and should preferably be about 0.05 to about 10 $\mu$m.

The charge generation layer, 4, receives light to generate charges. In addition, it is important that the charge generation efficiency is high and that the generated charges can be appropriately injected into the charge transportation layer, 5. It is desirable that the charges not significantly depend on electric fields, so that they can be appropriately injected despite low electric fields. The charge generation substance includes pigments or dyes, for example, phthalocyanine compounds, such as non-metal phthalocyanine and titanylphthalocyanine; various azo, quinone, indigo, cyanine, squialirium, azulenium, and pyrylium compounds; and selenium or its compounds, A preferred substance is selected depending on the light wavelength of an exposure light source used to form images. Since the charge generation layer requires only a charge generation function, its thickness is determined by the light absorption coefficient and quantity of the charge generation substance in the charge generation layer and is generally about 5 $\mu$m or less, and preferably, from about 0.1 to about 1 $\mu$m. The charge generation layer mainly comprises the charge generation substance, to which a charge transportation substance can be added. A resin binder may be an appropriate combination of polymers and copolymers of polycarbonate, polyester, polyamide, polyurethane, vinyl chloride resin, phenoxy resin, polyvinyl butyral, diallyl phthalate resin, and methacrylate.

The charge transportation layer, 5, is a film formed by dispersing in a resin binder any hydrazone compound, styril compound, amine compound, or a derivative or combination thereof. The charge transportation layer retains the charges in the photosensitive layer as an insulating layer when there is no light while transporting charges injected from the charge generation layer when light is received. The thickness of the charge transportation layer is preferably about 10 to about 40 $\mu$m. The resin binder may be a polymer or copolymer of polycarbonate, polyester, polystyrene, and methacrylate. When the photosensitive body obtained is used repetitively, an antioxidant comprising, for example, a amine, phenol, sulfur, phosphite, or phosphorus may be contained in the charge transportation layer, 5, to prevent it from being degraded by ozone resulting from corona discharge.

The photosensitive drum having the substrate of a transparent synthetic resin and the photosensitive layer containing an organic photoconductive substance allows surface charges to escape using the substrate for grounding while toner is being transferred to recording paper or electrostatic elimination is being executed after exposure and development. Thus, the formation of static latent images or the electrostatic elimination cannot be carried out smoothly if the substrate has a high electric resistance. Consequently, the sheet resistivity of the transparent conductive layer laminated on the resin substrate is preferably less than about $2\times10^6$ ω/□, but reducing the sheet resistivity below about $2\times10^2$ ω/□ is not preferable because it reduces the transparency.

EXAMPLE 1

The following procedure was used to obtain a photosensitive drum. A coating solution was obtained by mixing and dissolving 100 parts by weight of hydrazone (manufactured by Fuji Electric Co., Ltd.), 100 parts by weight of a polycarbonate resin (manufactured by Mitsubishi Engineering Plastics Co., Ltd.; Iupilon PCZ), and 800 parts by weight of dichloromethane. The coating solution was fed into a cylindrical mold, both ends of which were occluded. A centrifugal force was applied to the mold while being rotated by a roller (rotation frequency: 50 to 100 rpm). Air, heated to 50° C. to 60° C., was blown into the mold to dry the solvents in order to deposit the charge transportation material on the wall surface of the mold until its thickness reached 20 μm. At this point, a nickel plating containing polytetrafluoroethylene (PTFE) (manufactured by C. Uyemura and Company, Ltd.; Nimfron), was applied to the internal surface of the mold until its thickness reached about 10 μm to provide a release agent.

To produce a charge generation layer, a coating solution obtained by mixing and solving together 10 parts by weight of X-type inorganic metal phthalocyanine (manufactured by Dainippon Ink & Chemicals Inc.; FASTGEN BLUE 8120), 10 parts by weight of vinyl chloride resin (manufactured by Nippon Xeon Co., Ltd.; MR-110), 686 parts by weight of dichloromethane, and 294 parts by weight of 1,2-dichloroethane was applied to the cylindrical mold and air heated as described above to produce a film of about 0.5 μm thickness.

The underlayer, a coating solution obtained by mixing and solving together 5 parts by weight of alcohol-soluble polyamide resin (manufactured by Toray Industries, Inc.; Amilan CM8000) and 95 parts by weight of methanol was fed to provide a film of about 0.5 μm thickness, and then a transparent conductive material (ITO paint; manufactured by Catalysts and Chemicals Industries Co., Ltd.; ELCOM P-1202; sheet resistivity: $1.3\times10^3$ ω/□) was fed to obtain a film of about 1 μm thickness.

The photosensitive layer laminated as described above was sufficiently hot-air-dried, and then a specified amount of material formed by mixing an appropriate amount of polymer catalyst in methyl methacrylate (acrylic resin monomer) was fed until its thickness became about 2 mm. The mold was rotated to provide centrifugal force while being heated to 40° to 50° C. for polymerization. After polymerization and hardening, both ends of the mold were opened and the cylindrical substrate integrated with the photosensitive layer was carefully removed.

EXAMPLE 2

This example provides a photosensitive drum in which the conductive layer comprises $SnO_2$ in place of ITO (Example 1). After the charge transportation layer, charge generation layer, and underlayer had been formed as described in Example 1, a transparent conductive liquid ($SnO_2$ paint; manufactured by Catalysts and Chemical Industries Co., Ltd.; ELCOM P-3530; sheet resistivity: $3.4\times10^5$ ω/□) was used to form a film, and then methylmethacrylate was centrifugally polymerized to obtain an integral photosensitive drum as described in Example 1.

EXAMPLE 3

The moldability, surface roughness, roundness, and dimensional accuracy of the photosensitive drums produced in Examples 1 and 2 were measured. The results are shown in Table 1 below.

TABLE 1

| | Example 1 | Example 2 |
|---|---|---|
| Transparent Conductive Material | ITO | $SnO_2$ |
| Moldability | Good | Good |
| Total ray transmittance (%) | 85 | 98 |
| Sheet resisuvity (Ω/□) | $1.3 \times 10^3$ | $3.4 \times 10^5$ |
| Surface roughness (μm) | 0.9 | 0.8 |

TABLE 1-continued

| | Example 1 | Example 2 |
|---|---|---|
| Roundness (μm) | 50 | 40 |
| Dimensional accuracy (ϕ30 + mm) | 0.05 | 0.03 |

Figure 3:
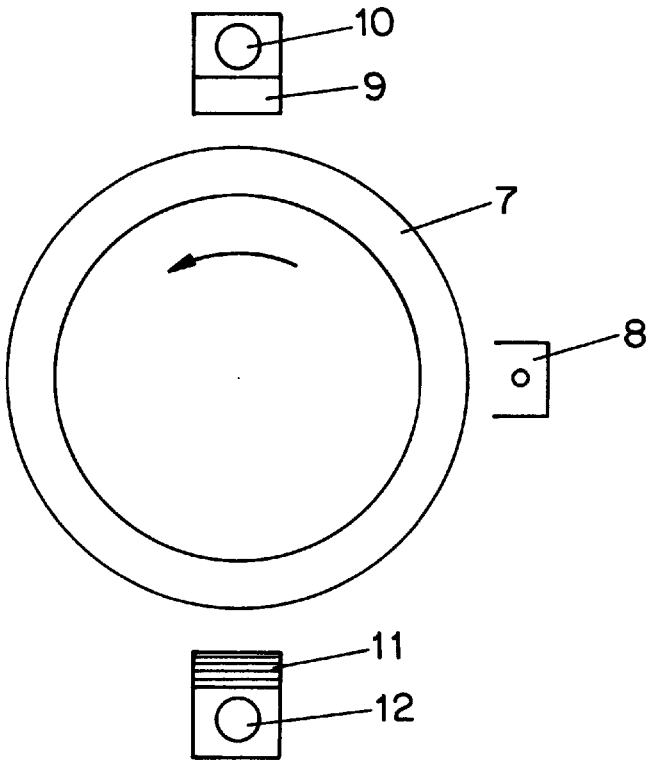
FIG. 3 is a schematic drawing showing the principle behind measurements executed by an electrical characteristics testing machine.

In addition, the initial electrical characteristics as photosensitive bodies of the photosensitive drums produced in Examples 1 and 2 were measured by a testing machine such as that shown in FIG. 3. Specifically, a photosensitive body, 7, was charged to −600 V by a scrotron charger, 8, while being rotated at a circumferential speed of 60 mm/sec in the direction 1 5 shown by the arrow. The potential of a probe, 9, having an exposure light source, 10, was measured during a non-exposure period as a dark potential $V_o$. The rotation was stopped to leave the photosensitive body in a dark place for five minutes, and its potential retention rate $V_{k5}$ (%) was determined. The photosensitive body was then exposed to light having a wavelength of 660 nm and irradiance of 2 $\mu w/cm^2$. 0.2 seconds later, its potential was measured as a bright 20 potential $V_i$ and 5 seconds after the exposure, its potential was measured as a residual potential, $V_r$. Since the photosensitive body was a surface exposure machine, a light shield was mounted on its internal surface for the measurements. In FIG. 3, 11 is an infrared filter and 12 is a electrostatic elimination light source. The results are also shown in Table 2 below.

Figure 4:
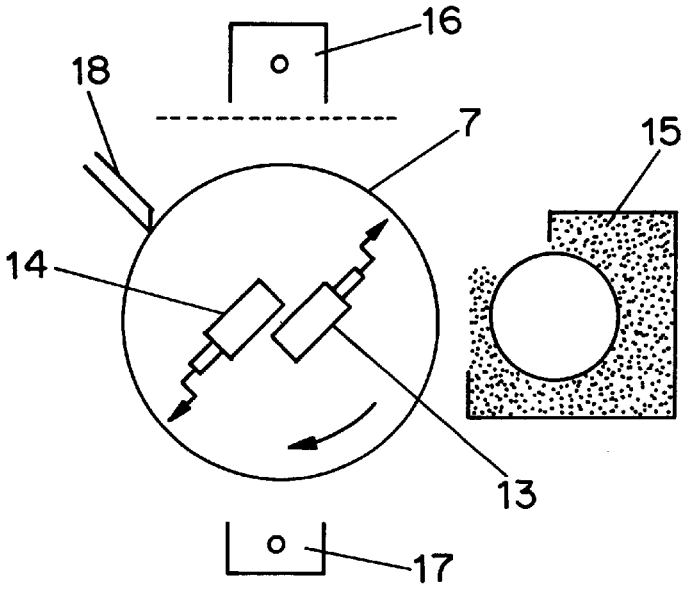
FIG. 4 is a process layout of a testing machine used as a printing characteristics testing machine.

The printing characteristics of the photosensitive drums obtained in Examples 1 and 2 were evaluated by a testing machine such as that shown in FIG. 4. In the testing machine shown in FIG. 4, 7 is a photosensitive body, 13 is an exposure light source, 14 is a electrostatic elimination light source, 15 is a developing machine, 16 is a charger, 17 is a transfer machine, and 18 is a cleaning blade. The results are shown in Table 2 below.

TABLE 2

| | Example 1 | Example 2 |
|---|---|---|
| $V_o$ (−V) | 655 | 650 |
| $V_{k5}$ (%) | 92 | 90 |
| $V_i$ (−V) | 63 | 66 |
| $V_r$ (−V) | 21 | 22 |
| Printing characteristics | Good | Good |

As is apparent from these tables, the photosensitive drums of Examples 1 and 2 have excellent electric and printing characteristics.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

Various references are cited herein, the disclosures of which are incorporated by reference in their entireties.

I claim:

1. A method for manufacturing an internally irradiated electrophotographic photosensitive body comprising the steps of:

(a) forming a photosensitive layer by sequentially forming in order, a charge transportation layer, a charge generation layer, and an underlayer on the internal surface of a rotating cylindrical mold by a centrifugally casting method;

(b) forming a transparent conductive layer on the internal surface of the underlayer by a centrifugally casting method, said transparent conductive layer comprising a transparent conductive coating material;

(c) forming a transparent resin substrate on the internal surface of the transparent conductive layer by centrifugally casting and polymerising a resin monomer of methyl acrylate such that the resin substrate is integrated with the transparent conductive substrate and the photosensitive layer.

2. The method according to claim 1, wherein said transparent resin substrate comprises polymethylmethacrylate.

3. The method according to claim 1, wherein said transparent conductive material is selected from the group consisting of indium tin oxide and $SnO_2$.

4. The method according to claim 1, wherein the transparent conductive layer has a sheet resistivity of about $2\times10^2$ to about $2\times10^6$ □/ω.

5. The method according to claim 1, wherein the thickness of the transparent conductive layer is about 0.5 μm to about 5 μm.

6. The method according to claim 1, wherein the thickness of the transparent conductive layer is about 1 μm to about 3 μm.

* * * * *

UNITED STATES PATENT AND TRADEMARK OFFICE

CERTIFICATE OF CORRECTION

PATENT NO. : 5,985,504
DATED : November 16, 1999
INVENTOR(S) : Noriaki Kawata

It is certified that error appears in the above-identified patent and that said Letters Patent is hereby corrected as shown below:

Title page,
Item [73] Assignee:"electric" should read -- Electric --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*